United States Patent [19]

Khramtsov et al.

[11] Patent Number: 4,510,849

[45] Date of Patent: Apr. 16, 1985

[54] APPARATUS FOR SYNCHRONIZING ACTUATORS

[76] Inventors: Alexandr A. Khramtsov, Novocherkassky prospekt, 55, kv. 38; Mikhail I. Tsyrkin, ulitsa Oberli, 13/21, kv. 40; Ilya E. Shinder, Bolotnaya ulitsa, 14, kv. 41, all of Leningrad, U.S.S.R.

[21] Appl. No.: 395,027

[22] PCT Filed: Oct. 24, 1980

[86] PCT No.: PCT/SU80/00176

§ 371 Date: Jun. 17, 1982

§ 102(e) Date: Jun. 17, 1982

[87] PCT Pub. No.: WO82/01572

PCT Pub. Date: May 13, 1982

[51] Int. Cl.[3] ..... F15B 11/00

[52] U.S. Cl. ..... 91/515; 91/171; 91/517; 92/49

[58] Field of Search ..... 60/700, 701, 546; 91/171, 511, 514, 515, 532, 517, 518, 170 R, 519, 388; 92/49

[56] References Cited

U.S. PATENT DOCUMENTS 3,048,743 8/1962 Chillson ..... 60/700
3,355,993 12/1967 Williamson ..... 91/171
3,772,884 11/1973 Witt ..... 60/701

FOREIGN PATENT DOCUMENTS 496381 3/1976 U.S.S.R. ..... 91/515
649889 3/1979 U.S.S.R. ..... 91/515

*Primary Examiner*—Abraham Hershkovitz
*Attorney, Agent, or Firm*—Lilling & Greenspan

[57] ABSTRACT

An apparatus for synchronizing a plurality of actuators, comprising a pressure fluid source 15 associated with a setting device 6, with transmitters 10 of the movements of the operating members 5, and also with multichamber adding elements 17 equal in number to the actuators 4 to be synchronized. Each of the adding elements 17 includes an inlet chamber 36 associated with one of the actuators 4 and an outlet chamber 37 associated with the inlet chamber 36 and with a pressure fluid drain means 16, and further includes positive control chambers 24, 26 and 28 serving to increase the fluid supply through the inlet chamber 36 to the actuator 4 and negative control chambers 25, 27 and 29 serving to decrease the pressure fluid supply, the inlet chamber 36 of each adding element 17 being associated with one of the negative control chambers 25, 27 and 29 of the same adding element 17, one of the positive control chambers 24, 26 and 28 of each element 17 being associated with the output of the setting device 6, while the output of the transmitter 10 of each actuator 4 is associated with such a number of negative control chambers 25, 27, 29 of the adding element 17 associated with the same actuator 4, which is one unit less than the number of the actuators 4 to be synchronized, and also with one of the positive chambers 24, 26, 28 of the rest of the adding elements 17.

3 Claims, 2 Drawing Figures

APPARATUS FOR SYNCHRONIZING ACTUATORS

BACKGROUND OF THE INVENTION

1. Field of the Invention

The present invention relates to pneumatic and hydraulic control systems comprising a number of actautors, and more particularly to methods of synchronizing actuators and apparatus for implementing the same.

Still more particularly, the present invention relates to methods of and apparatus for synchronizing two or more actuators of prime or secondary movers operating in parallel into a common load.

The present invention can most advantageously be used in multiple-unit transport power plants comprising Diesel engines or turbines and providing at the same time the operation of an electric generator.

2. Description of the Prior Art

At present the ships of various types are often equiped with two-unit Diesel power plants where the movers operate into a common load, viz. one propeller. In those cases, when two or more prime or secondary movers operate into a common load it becomes necessary to provide equal load distribution between these units, especially when the load changes. Thus, for example, if the total load on the movers is sharply increased due to external reasons, each of these movers should continue to contribute into the total load, its contribution being equal in magnitude to that prior to the increase. It means that correlation between the contributions of individual movers to the total load should remain unchanged.

Equalization of the load is provided through corresponding synchronization of the operation of the mover actuators, in particular fuel or any other energy supply regulators. The main reasons accounting for unequal load distribution between the engines are the following:

unequal time of response to the change of the load in various movers or, in other words, unequal time constant of the movers;

unequal character of transmission, in actuators of different movers, of a control signal applied to said actuators from the common setting device into useful movement of their operating members due to unavoidable deviations in geometrical dimensions of the elements constituting the actuators as well as due to their temporary misadjustment, etc.;

unequal speed of transmission of control signals both through the common control circuit and through feedback circuits.

Unequal distribution of the load between the movers results in the loss of preset speed or moments and increased fuel consumption as well as underloading or overloading of some movers and thereby their premature ware and even failure. The present invention is directed at providing a method of synchronizing actuators and an apparatus implementing said method ensuring uniform distribution of the common load between the movers.

Known to the art is a method of synchronizing actuators (Cf. USSR Inventor's Certificate No. 496381, published in 1973), applied in control of mechanized tunnel shield. This method comprises the steps of measuring in the process of the tunnel shield operation, the values of displacement of the operating members, namely the rods of all hydrocylinders used therein with respect to a base point, deriving signals corresponding to the displacement of each rod, separating out of said signals the lowest one and separately comparing the obtained signals to derive a correction signal used for adjusting the position of the rod of each hydrocylinder through changing the supply of the pressure fluid to its operating volume, said correction signal being proportional in magnitude to the difference between the signal corresponding to the displacement of the rod of any hydrocylinder and the signal corresponding to the shortest displacement of all the rods relative to the base point.

Synchronization of hydrocylinders in accordance with this method is a complicated process requiring the sequence of the following procedures:

comparing the rod position of each hydrocylinder with the position of the base point;

selecting out of the displacement of the rods of hydrocylinders the shortest displacement;

deriving from several comparing devices control signals proportional in magnitude to disagreement between the position of the rod of each hydrocylinder and the position of the rod of the hydrocylinder deviated by minimum value from the position of the base point.

Such intricate scheme of producing control action fails to provide sufficient accuracy and synchronization speed of the actuators.

The apparatus implementing the afore-mentioned method comprises a setting device adapted to exert a common control action on the movement of the rod of each hydrocylinder, displacement transducers for the rods of hydrocylinders and adjustable pressure fluid sources, each of said sources being connected with one of the hydrocylinders through an individual line accommodating an electrohydraulic regulator. In this apparatus the output of each of the displacement transducer is connected to one of the inputs of a means adapted to derive a signal of minimum error between the position of the base point and the position of each rod of hydrocylinders as well as to one of the inputs of one of the main comparing devices, the other input of each said device being connected to the output of the means of producing said signal, while the output thereof being connected to the control input of one of the electrohydraulic regulators. The output of each displacement transducer is connected, besides, to one of the inputs of one of the additional comparing devices, the other input of each said device being connected to the output of the setting device and its output being connected to one of the pressure fluid sources.

Thus, this apparatus comprises a comparatively large number of elements and therefore it is rather complicated in design. In the above apparatus each hydrocylinder to be synchronized is associated with one pressure fluid source and with two comparing devices, one of which besides is controlled by the auxiliary means adapted to select minimum deviation from the position of the base point. As a result, the reliability and speed of response of this apparatus are comparatively low. Moreover, application and potentialities of this apparatus are limited by the necessity to use the base point.

Also known to the prior art is a method of synchronizing actuators (Cf. U.S. Pat. No. 3,772,884, published Nov. 20, 1973), which actuators are the regulators of the prime movers driving a common load, each having a movable operating device providing fuel supply to the associated prime mover. This method comprises the steps of measuring the movement of the operating device of the regulators, corresponding in magnitude to the fuel supply and therefore the loads on the associated engines to derive signals corresponding to the movement of each operating member of each regulator, comparing said signals to derive a single signal which is the average of said signals followed by separate comparing each said signal corresponding to the movement of each operating member of each regulator against the signal corresponding to the average of said signals, and adjusting the position of the operating member of each regulator in a direction and by an amount proportional to the correction signal derived from said comparison. The correction signal is produced in such a way that it is proportional in magnitude to the difference between the signal corresponding to the movement of the operating member of any one of the regulators and the signal which is the average of movements of the operating member of all the regulators.

The apparatus implementing this method of synchronizing actuators, described in the afore-mentioned U.S. Pat. No. 3,772,884, comprises a setting device adapted to exert a common control action on the movement of the operating member of each regulator, a pressure fluid source associated with transducers of the movement of the operating members of the regulators and with a comparing device adapted to produce a control action on the regulators and associated with the regulators and with the transducers of the movement of the operating members of said regulators. The comparing device is a multichamber adding element having a housing accommodating an axially movable stem and a spring-loaded valve which can be in contact with said stem. Secured to the stem are diaphragms dividing the interior of the housing into positive control chambers providing the movement of the stem in one direction in response to the pressure build up therein and into negative control chambers providing the movement of the stem in the opposite direction. The housing also accommodates an inlet chamber actuating the valve and thereby providing transmission of the control action from the pressure fluid source to the actuators due to the movement of the stem in said one direction by the sum of the pressures in the positive control chambers exceeding the sum of the pressures in negative control chambers, and an outlet chamber communicated with the inlet chamber and operatively associated with the fluid pressure drain means when the sum of the pressures in the negative control chambers exceeds said sum in the positive control chambers. The positive control chambers of the multi-chamber adding element are connected with the transmitters of the movement of the operating member of the regulators and the negative control chambers are connected with each other, their common output being connected through intermediate two-chamber comparing device with the operating member of the regulators. Due to such connection of the negative and positive control chambers a signal is derived which is an average of the movements of said operating members of the regulators. In more details, the common output of the negative control chambers is connected with one of the chambers of each intermediate two-chamber comparing device, the other chamber of which is connected with the transmitter of the movement of the operating member of one of the regulators, the output movable element of this comparing device being connected with the operating member of the same regulator.

In spite of the fact that the afore-mentioned method and the apparatus implementing this method have some advantages as compared to the prior described one they do not still provide sufficiently high accuracy and quickness of synchronization of the actuators and therefore the accuracy and quickness of the process of equalization of the load between the associated prime movers operating in parallel. This is stipulated by the fact that, in the first place, this method and apparatus for implementation thereof comprise two steps of signal comparison, each of said steps introducing its own error into the process of synchronization and, in the second place, in one of these comparing steps a signal is used which is the average of the movement of the operating members. The use of such average value accounts for comparatively low correction signal and results in, in general, still further decrease in the value of the correction signal with the increase in the number of synchronized actuators. Moreover, the use of the average value introduces itself some uncertainty into the process of synchronization. It is necessary also to point out the fact that in the apparatus realizing said method the common control action is transmitted from the setting device to the regulators through an additional means and that the element disconnecting the comparing device from the synchronizing circuit introduced from the purpose of more comfortable manipulation of said apparatus comprises a lot of valve means complicating the construction of this apparatus.

SUMMARY OF THE INVENTION

The present invention is based on the objective of developing such a method of synchronizing the actuators of prime or secondary movers driving a common load and of providing such a simple in design apparatus implementing this method, as to provide a substantial decrease in the nonuniformity of the load distribution between these movers with changes of the common load on the movers or with changes of the load on one of them in a sufficiently wide range.

To achieve the aforesaid objective, there is provided a method of synchronizing actuators, each having a movable operating member and providing control of one of the prime or secondary movers driving a common load through varying the amount of the energy medium supplied to said movers, comprising the steps of measuring the movement of the operating members of the actuators, corresponding in magnitude to said medium supplied and, therefore to the loads on said movers associated with the actuators to derive signals corresponding to the movement of the operating member of each actuator, and adjusting the position of the operating member of each actuator in a direction and by an amount equal to the correction signal derived from comparison of the signals corresponding to the movement of the operating member of each actuator, wherein, according to the invention, the correction signal is derived so that it is proportional in magnitude to the sum of differences between the signal corresponding to the movement of the operating member of any one of the actuators and each of the signals corresponding to the movement of the operating member of the rest of the actuators.

Due to such way of producing the correction signal synchronization of the actuators is accomplished with higher accuracy and quickness.

To achieve the aforesaid objective, there is also provided an apparatus implementing the above-method of synchronizing actuators, comprising a pressure fluid source associated with a setting device adapted to set a common control action on the movement of the operating member of each actuator, said movement providing the energy medium supply to the prime or secondary movers, and also associated with transmitters of the movement of the operating members of the actuators and with a comparing device adapted to produce a control action on the actuators, said comparing device being associated with the actuators and with the transmitters of the movement of the operating members of the actuators and representing a multichamber adding element having a housing closed at opposite ends and accommodating a stem movable axially in opposite directions relative to its central position and secured to a plurality of diaphragms disposed within the housing, one part of said diaphragms having an effective area of each diaphragm larger than that of the other part, said diaphragms being mounted within the housing in such a manner that the diaphragms with different effective area alternate and divide the interior of the housing into positive control chambers providing the movement of the stem off-center in one direction in response to the pressure build up therein, negative control chambers providing the movmenet of the stem in the opposite direction in response to the pressure build up therein, an inlet chamber which connects the pressure fluid source with the actuator when the stem is moved in said one direction by the sum of the pressures in the positive control chambers exceeding the sum of the pressures in the negative control chambers, an outlet chamber connected with an inlet chamber and communicated, when the stem is moved in said opposite direction by the sum of the pressures in the negative control chambers exceeding the sum of the pressures in the positive control chambers, with a pressure fluid drain means, wherein, in accordance with the invention, adding elements at the above type are additionally introduced in such a quantity that the total number of the adding elements is equal to the chamber of the actuators to be synchronized, the inlet chamber of each adding element being communicated with one of the negative control chambers of the same adding element, one of the positive control chambers of each adding element being connected with the output of the setting device and the output of the transmitter of the movement of the operating member of each actuator being connected with such a number of negative control chambers of the adding element associated with the same actuator which is one unit less than the number of synchronized actuators and with one of the positive control chambers of the rest of the adding elements.

In the proposed apparatus of synchronizing actuators, the correction signal is derived and the common control signal for each actuator is applied through one comparing device, said signals being in the same scale.

It is reasonable that the output of the transmitter of the movement of the operating device of each actuator be connected to corresponding control chambers of the adding elements through an adjustable throttle.

Application of the adjustable throttle gives the possibility to adjust the time constants of said transmitters.

It is reasonable also that the inlet chamber of each adding element be connected with a respective actuator through an adjustable throttle.

This adjustable throttle gives the possibility to adjust the movement of the operating device of each actuator.

BRIEF DESCRIPTION OF THE DRAWINGS

The present invention will become more apparent from the following description used to illustrate preferred embodiments of the invention taken in conjunection with the accompanying drawings, in which.

BEST MODE TO CARRY OUT THE INVENTION

Figure 1:
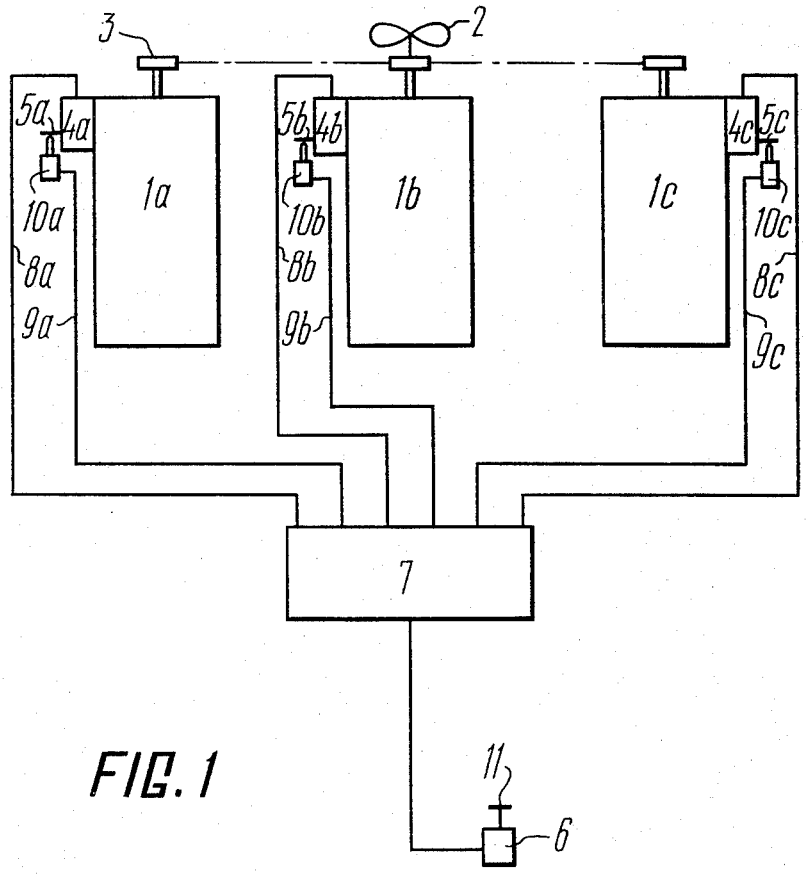
FIG. 1 is a block-diagram of control of several prime or secondary movers, illustrating a method of synchronizing actuators in accordance with the present invention.

FIG. 1 shows a conventional view of prime or secondary movers designated by 1*a*, 1*b* and 1*c* which can be both internal combustion engines and pneumatic or hydraulic engines and which, in this particular case, are Diesel engines used as a part of the marine power plant driving a common load, namely a ship propeller 2 with which these engines are communicated through a reducing gear equipped with gear wheels 3. The movers 1*a*, 1*b* and 1*c* are controlled through individual actuators 4*a*, 4*b* and 4*c* respectively which can be devices of various types with movable operating elements and which, in this particular case, are pneumatic drive mechanisms exerting an effect on the speed governors of these movers.

Each actuator 4 has a movable operating member 5 connected with a fuel pump rod (not shown) which is responsible for fuel supply to the respective controlled mover 1. The common control action on the actuators 4 is effected with the help of a setting device 6 through a device 7 which provides distribution of the control signals from the setting device 6 and comparison of the control signals passing along forward and feedback circuits 8 and 9, respectively. Arranged in the feedback circuits are transmitters 10 of the movement of the operating members 5 of the actuators 4. The transmitters 10 are pneumatic devices transforming translational movement of the operating member 5 into a pneumatic signal. The setting device 6 is also a device of pneumatic type transforming rotation of its operating member 11 into a pneumatic signal and therefore the circuits 8 and 9 are ordinary pipes as they will be further called.

The proposed method of synchronizing actuators comprises the following steps. During operation of the movers 1 the fuel is continuously supplied thereto. With the change in the load on the movers 1 in course of their operation the amount of fuel supplied to said movers is varied by respective actuators 4 on account of the movement of the fuel pump rods of each mover 1 and therefore the operating members 5 associated with the actuators 4. The movement of the operating members 5*a*, 5*b* and 5*c* corresponding in magnitude to the change in the load on each mover 1 is sensed by the transmitters 10*a*, 10*b* and 10*c* respectively to derive in said transmitters respective pneumatic signals applied through pipes 9*a*, 9*b* and 9*c* to the comparing device 7 which compares the signals corresponding to the movement of the operating member 5 of each actuator 4 to derive therefrom a respective correction pneumatic signal. In the proposed method this correction signal is formed so that it is proportional in magnitude to the sum of the differences between the signal corresponding to the movement of the operating member 5 of any single actuator 4 and each signal corresponding to the movement of the operating member 5 of the rest of said actuators. The derived correction signals are used then to adjust the position of the operating member 5 of each actuator 4 in a direction and by an amount equal to said signal so as to equalize the loads on the movers 1, the correction signals being applied through the pipes 8.

FIG. 1 shows for ease of illustration three movers and three associated actuators. It is necessary to understand, however, that the method of synchronizing actuators in accordance with the present invention can be used for synchronizing any number of actuators.

Figure 2:
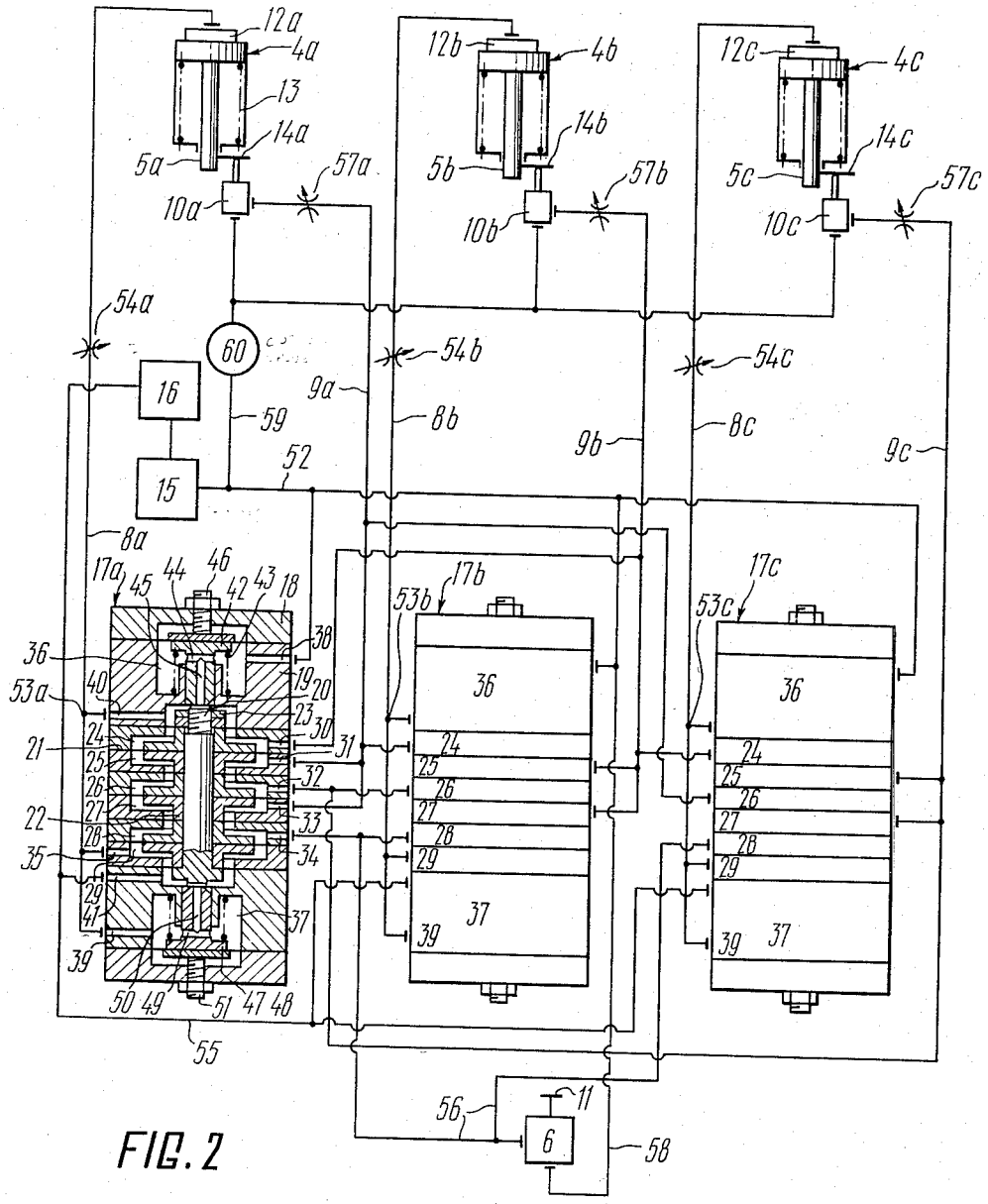
FIG. 2 is a structural diagram of the apparatus implementing the proposed method of synchronizing actuators in accordance with the present invention.

The apparatus implementing the proposed method, illustrated in FIG. 2, comprises pneumatic one-way actuators 4*a*, 4*b* and 4*c* each having a cylinder with an operating volume 12 and a piston loaded by a spring 13 and having a rod, which is an operating member 5 of this actuator. The operating member 5 of each actuator 4 is associated through a lever 14 with one of the movement transmitters 10 which are pneumomechanical sensitive devices of a diaphragm type with force compensation. The described apparatus further comprises a pressure fluid source 15 which is an aircompressor producing a pressure of about 0.137 MPa (1.4 kgf/cm$^2$) and equipped with a pressure fluid drain means 16, and multichamber adding elements 17*a*, 17*b* and 17*c* equal in number to actuators 4 to be synchronized.

Each multichamber adding element 17 comprises a cylindrical housing 18 closed at opposite ends and made of bowl-shaped elements 19 centrally apertured. The bowl-shaped elements 19 are mounted along the vertical extent of the housing 18 in pairs in such a manner as to face each other in each pair by their bottom parts, each pair of said elements forming in the wall of the housing 18 a circular projection toward the axis of the housing 18 with a circular groove between such pairs. Disposed within the housing 18 is a central stem 20 movable axially in opposite directions relative to its center position and a number of flexible diaphragms 21 secured to said stem 20 and axially spaced therein. Each one of the diaphragms 21 clamped around their peripheries to the wall of the housing 18 is secured at its center to the stem 20 by the sleeves 22 mounted on said stem. The sleeves 22 have T-shaped longitudinal section and are mounted along the vertical extent of the stem 20 in pairs in such a manner as to face each other in each pair by their wider parts, the diaphragms 21 being arranged just between the faces of said parts. Each pair of the sleeves 22 forms on the stem 20 a circular projection towards the wall of the housing 18, a groove being formed on the stem 20 between such pairs. The central stem 20 is mounted within the housing 18 is such a manner that the circular projections of this stem come into the circular grooves of the wall of the housing 18 not contacting however the surfaces of these grooves. With this arrangement one part of the diaphragms 21 has its centrals secured to the stem 20 at the site of its circular projection, while their peripheries are secured to the wall of the housing 18 at the site of its circular groove and the other part of the diaphragms 21 has it vice versa. As a result, in one part of the diaphragms 21 an effective area of one diaphragm is larger than that of the other part and the diaphragms with different effective areas are arranged alternatively. The sleeves 22 and the diaphragms 21 mounted therebetween are clamped together by a nut 23 screwed onto the stem 20.

The diaphragms 21 divide the interior of the housing 18 into several control chambers, namely 24, 25, 26, 27, 28 and 29 disposed in the middle partion of the housing 18. The chambers 24, 26 and 28 are positive control chambers providing the movement of the stem 20 in one direction relative to its central position, i.e. downwardly (reference to the drawing) in response to the pressure build up therein, and the chambes 25, 27 and 29 are negative control chambers providing the movement of the stem 20 in the opposite direction, i.e. upwardly (reference to the drawing) in response to the pressure build up therein. The control chambers 24, 25, 26, 27, 28 and 29 are made closed and are provided with inlet passages 30, 31, 32, 33, 34 and 35 respectively.

Each adding element 17 is provided with an inlet chamber 36 and an outlet chamber 37 disposed within the housing 18 at the ends thereof. The inlet 36 and the outlet 37 chambers are made as fluid-running chambers and have inlet passages 38 and 39 and outlet passages 40 and 41 respectively. Mounted in the inlet chamber 36 is a nozzle 42 loaded by a spring 43 and having a radial passage 44 and an axial passage 45 to supply the pressure fluid. The nozzle 42 is provided with an adjusting screw 46 adapted to adjust the nozzle 42 in initial position and thereby to set the value of the operating pressure applied to the adding element 17. Similar to that, the outlet chamber 37 includes a nozzle 47 loaded by a spring 48 and having a radial passage 49 and an axial passage 50 and an adjusting screw 51, the outlet ends of the nozzles 42 and 47 facing the ends of the movable stem 20.

Described above is one of the adding elements 17, namely, and adding element 17*a* presented as a sectional view in FIG. 2. The adding elements 17*b* and 17*c* are shown on this drawing schematically for they are exactly of the same construction as the adding element 17*a*.

In each one of the adding elements 17, the inlet passage 38 of the inlet chamber 36 is connected by the pipe 52 with the pressure fluid source 15 and the outlet passage 40 of this chamber is connected with the inlet passage 39 of the outlet chamber 37 and with one of the negative control chambers, namely with the inlet passage 35 of the chamber 29. Communication of the inlet chamber 36 with the negative control chamber 39 in each adding element 17 is necessary to form negative feedback providing analogue character of the output signal of said elements. A common output 53 of each adding element 17 is connected through the pipe 8 with the operating volume 12 of the respective actuator 4 through an adjustable throttle 54. The latter has an adjustable cross-section due to which the speed of the pressure build up can be changed at the inlet to the operating volume 12 and thereby the time of operation of each actuator 4 and the associated adding element 17 matched. Moreover, in each adding element 17 the outlet passage 41 of the outlet chamber 37 is connected through a pipe 55 with the pressure fluid drain means 16 to allow the air escape from this chamber to the atmosphere, and the inlet passage 34 of the positive control chamber 28 is connected through a pipe 56 with the output of the setting device 6.

The output of the transmitter 10*a* of the movement of the operating device 5*a* of the actuator 4*a* is connected by the pipe 9*a* through an adjustable throttle 57*a*, which is similar to the throttles 54 and is adapted to match the time constants of the transmitter 10*a* and the adding element 17*a*, with the inlet passage 31 of the negative control chamber 25 and with the inlet passage 33 of the negative control chamber 27 of the same element, as well as with the positive control chamber 24 of the adding element 17*b* an with the positive control chamber 26 of the adding element 17*c*. Similar to that the output of the transmitter 10*b* is connected by the pipe 9*b* through an adjustable throttle 57*b*, same as the throttles 57*a*, with the negative control chambers 25 and 27 of the adding element 17*b*, with the positive control chamber 24 of the adding element 17*a* and with the similar chamber 24 of the adding element 17*c*, while the output of the transmitter 10*c* is connected by the pipe 9*c* through an adjustable throttle 57*c* with the negative control chambers 25 and 27 of the adding element 17*c* and with the positive control chambers 26 of the adding elements 17*a* and 17*b*. In other words, irrespective of the number of synchronized actuators 4 the output of the transmitter 10 of the movement of the operating device 5 of each actuator 4 is connected with the same number of negative control chambers of the adding element 17 associated with this particular actuator 4, said number being one unit less than the number of synchronized actuators 4, and with one of the positive control chambers of the rest of the adding elements 17.

The setting device 6 is connectd with the pressure fluid source 15 by means of a pipe 58, and the transmitters 10 of the movement of the operating members 5 of the actuators 4 are connected by a pipe 59 with said source through a cut-out valve 60 providing disconnection, if necessary, from the supply of said transmitters as well as opening the feedback circuit in the synchronizing circuit of the actuators 4 and thereby putting said actuators out of synchronous operation. The cut-out valve 60 makes possible to switch off the synchronizing circuit and to continue the operation of the actuators 4 in case the failure occurs in the transmitters 10, in the pipes, etc. or in any other particular cases.

The apparatus for synchronizing actuators of prime or secondary movers in accordance with the present invention operates as follows.

Before the synchronizing apparatus is switched on the movers 1 (FIG. 1) are separately started and set for the preliminary cycle of operation without loading. At this stage the transmitters 10 are not energized and therefore the synchronizing circuit of said actuators is not under operation. To make the movers 1 to work at the required speed at this starting stage the operating member 11 of the setting device 6 is adjusted to a corresponding position, the pneumatic signal from the output of the setting device 6 being transmitted through the pipe 56 (FIG. 2) to the positive control chambers 28 of all the adding elements 17. As a result the stem 20 is moved downwardly (here and furtheron in the text with reference to the plane of the drawing) under the effect of the pressure applied to the chambers 28, due to which in the inlet chambers 36 the clearance between the nozzle 42 and the end of the stem 20 facing thereof is increased and in the outlet chambers 37 the clearance between the nozzle 47 and the end of the stem 20 facing thereof is decreased. In other words, the nozzle 42 is opened and the nozzle 47 is closed, whereby at the output 40 of the inlet chambers 36 the air pressure applied from the source 15 through the pipe 52 and admitted to these chambers through the inlet passages 38, radial passage 44 and axial passage 45 starts to build up, this process being promoted also by the fact that the escape of air to the atmosphere from the outlet chambers 37 through the axial passage 50, radial passage 49 and outlet passage 41 decreases herewith. The stem 20 in each adding element 17 occupies, due to the negative feedback through the negative control chamber 29, a position providing the pressure at the common outputs 53*a*, 53*b* and 53*c* equal to the pressures applied to the positive control chambers 28, i.e. at this stage the adding elements 17 operate as repeaters of the signal transmitted from the setting device 6.

The pneumatic signals derived in the adding elements 17 are applied via the pipes 8*a*, 8 *b* and 8*c* through the adjustable throttles 54*a*, 54*b* and 54*c* to the operating volumes 12*a*, 12*b* and 12*c* of the actuators 4*a*, 4*b* and 4*c*, respectively. The rods, or the operating members 5 of these actuators start to move downwardly compressing the springs 13. The fuel supplied to the movers 1 (FIG. 1) corresponds in magnitude to the movement of the operating members 5. However, common equal action from the setting device 6 on the actuators 4 does not result in equal movement of their operating members 5 due to unavoidable difference in characteristics of the elements constituting the circuits of transmission of this action and therefore the movers 1 receive different settings for speed. But since the movers 1 cannot have different speed due to rigid connection therebetween, some of them are overloaded when the load is applied thereto while the others are underloaded relative to their rates load. This can be accompanied by variations in the resulting underloading or overloading leading to injurious consequences mentioned above. Therefore prior to loading the movers 1, synchronization of actuators 4 is carried out by energizing the transmitters 10 through the valve 60 (FIG. 2) to equalize the loads on all of said engines.

When the valve 60 is actuated, the movement of the operating members 5 of the actuators 4 is transmitted through the levers 14 to the movable elements of the transmitters 10 developing corresponding output signals. The output pneumatic signals of the transmitter 10*a* are applied in the adding elements 17*a* to the negative control chambers 25 and 27, in the adding element 17*b*, to the positive control chamber 24, and in the adding element 17*c*, to the positive control chamber 26. The output pneumatic signals from the transmitter 10*b* are applied in the adding element 17*b* to the negative control chambers 25 and 27, and in the elements 17*a* and 17*c*, to the positive control chambers 24, and the output signals from the transmitter 10*c* are applied in the element 17*c* to the negative control chambers 25 and 27, and in the elements 17*a* and 17*b*, to the positive control chambers 26. In the case when the movement of all the operating members 5 is equal, the forces from the transmitters 10 on each one of the adding elements 17 are also equal. Therefore the pressures in the control chambers of the adding element 17 are mutually compensated, and the stems 20 of the adding elements 17 do not move, whereby only the pneumatic signal from the setting device 6 passes into the operating volume 12 of each actuator 4.

When, due to any reasons, the load on any of the movers 1 (FIG. 1) increases, for example, on the mover 1*a*, this engine consumes moe fuel and the operating member 5*a* of the actuator 4*a* moves downwardly, while the position of the operating members 5*b* and 5*c* of the actuators 4*b* and 4*c* at that moment remains unchanged. As a result, the pressure at the output of the transmtter 10*a* increases. This build up of the pressure is transmitted through the pipe 9*a* to the control chambers 25 and 27 of the adding element 17*a*, and the pressure at the common output 53*a* of this element decreases since said control chambers are negative ones. This pressure drop is transmitted through the pipe 8*a* to the operating volume 12*a* of the actuator 4*a*, whereby its operating member 5*a* moves upwardly thereby decreasing the fuel supply to the associated mover 1*a*, which is accompanied by the pressure drop at the output of the transmitter 10*a*.

Simultaneously the signal of the pressure build up from the output of the transmitter 10*a* is applied to the positive control chamber 24 of the adding element 17*b*, causing the pressure build up at the output 53*b* of said element. This build up of the pressure is transmitted through the pipe 8*b* to the operating volume 12*b* of the actuator 4*b* whereby its operating member 5*b* is moved downwardly thereby increasing the fuel supply to the associated mover 1*b*. This is accompanied by the pressure build up at the output of the transmitter 10*b*.

Besides, the signal of the increased pressure from the output of the transmitter 10*a* is applied to the positive control chamber 26 of the element 17*c* which also results in the pressure build up at the output 53*c* of this element, this pressure build up being transmitted through the pipe 8*c* to the operating volume 12*c* of the actuator 4*c*, whereby its operating member 5*c* moves downwardly thereby increasing the fuel supply to the associated mover 1*c*. This is accompanied by the pressure build up at the output of the transmitter 10*c*.

Thus, when the load on the mover 1*a* is increased, the regulating effect exerted on the actuator 4*a* from the adding element 17*a* tends to decrease the fuel supply to that mover, while the regulating effect exerted on the actuators 4*b* and 4*c* from the adding elements 17*b* and 17*c* tends to increase the fuel supply to the movers 1*b* and 1*c*. The process of changing the pressures at the common outputs 53 of the adding elements 17, and thereby the position of the operating members 5 of the actuators 4, is over when, as a result of the movement of these operating members in the direction towards each other, the pressures at the output of the transmitters 10*a*, 10*b* and 10*c* are equalized. This brings to redistribution of the amount of fuel supplied to each mover 1 and equalization of the loads on said movers. The synchronizing apparatus thus decreases the load on the overload mover 1*a* and increases the load on the underloaded movers 1*b* and 1*c*.

Assume now that the load is increased on the movers 1*a* and 1*b* by the same amount. These movers start to consume more fuel and the operating members 5*a* and 5*b* respectively of the actuators 4*a* and 4*b* are moved downwardly. As a result, the pressure at the inputs of the transmitters 10*a* and 10*b* is increased practically by the same amount, and this pressure build up at the output of said transmitters is transmitted through the pipes 9*a* and 9*b*, as described above, to the control chambers of all the adding elements 17.

In the adding element 17*a* the signals of the pressure build up are applied to the negative control chambers 25 and 27 from the transmitter 10*a* and to the positve control chamber 24 from the transmitter 10*b*. Since two of these three chambers are negative control chambers, the pressure at the common output 53*a* of the adding element 17*a* decreases causing the movement of the operating member of the actuator 4*a* upwardly and thereby decreasing fuel supply to the mover 1*a*. This is accompanied by the decrease in the pressure at the output of the transmitter 10*a*.

In the adding element 17*b* the signal of the pressure build up from the transmitter 10*b* is applied to the negative control chambers 25 and 27 and from the transmitter 10*a*, to the positive control chamber 24. As a result, similar to the adding element 17*a*, the pressure at the common output 53*b* of the element 17*b* decreases causing also the movement of the operating member 5*b* of the actuator 4*b* upward and thereby decreasing the fuel supply to the mover 1*b*. This is accompanied by the decrease in the pressure at the output of the transmitter 10*b*.

In the adding element 17*c* the signals of the pressure build up from the transmitter 10*b* are applied to the positive control chamber 24 and from the transmitter 10*a* to the positive control chamber 26. Since both these control chambers are positive, the pressure at the output 53*c* of the element 17*c* increases causing the movement of the operating member 5*c* downward thereby increasing the fuel supply to the mover 1*c*. This is accompanied by the pressure build up at the output of the transmitter 10*c*.

Thus, when the load on the movers 1*a* and 1*c* increases the regulating effect exerted on the actuators 4*a* and 4*b* from the adding elements 17*a* and 17*b* tends to decrease the fuel supply to said movers, while the regulating effect exerted on the actuator 4*c* from the adding element 17*c* tends to increase the fuel supply to the mover 1*c*. The process of changing the position of the operating members 5 of the actuators 4 is over when, as a result of the movements of said operating members in the directions towards each other, the loads on the movers 1 are equalized.

Other changes in the loads on the movers 1 result in the processes similar to those described above.

In the proposed apparatus for synchronizing actuators the setting device 6 and the transmitters 10 of the movement of the operating members 5 of said actuators produce the pneumatic signals in one pressure scale. Change of the pressure at the output, respectively, of the setting device 6 and the transmitters 10 corresponds to the change in the speed of the movers 1 from zero to the rated value, and also to the change in the amount of the fuel supplied therein from the value corresponding to the idle operation to the rated value. This change lies within the range from 19.6 to 98.0 KPa (from 0.2 to 1.0 kgf/cm$^2$). To illustrate the operation of the described synchronizating apparatus an equation can be made in accordance with FIG. 2 which defines the pressures on the common outputs 53 of the three adding elements 17. These equations are:

$$P_A = p_o - p_1 - p_1 + p_2 + p_3 = p_o + (p_2 - p_1) + (p_3 - p_1), \quad (1)$$

$$P_B = p_o - p_2 - p_2 + p_1 + p_3 = p_o + (p_1 - p_2) + (p_3 - p_2), \quad (2)$$

$$P_C = p_o - p_3 - p_3 + p_1 + p_2 = p_o + (p_1 - p_3) + (p_2 - p_3) \quad (3)$$

where $P_A$, $P_B$, $P_C$ are output pneumatic signals of the adding elements 17*a*, 17*b* and 17*c* respectively applied to the actuators 4*a*, 4*b* and 4*c*, $P_o$ is an output pneumatic signal of the setting device 6, $p_1$, $p_2$, $p_3$ are output pneumatic signals of the transmitters 10*a*, 10*b* and 10*c* respectively, their signs corresponding to the type of the control chambers of the adding element 17 whereto said signals are applied.

In the first part of the equations (1) to (3) the member $p_o$ defines the control action of the actuators 4 and the rest of the members define the corrective effect on said actuators.

It is not difficult to make sure that for "n" of the actuators 4 the equations of the summing effect on each of said actuators have the following form:

$$P_A = p_0 + p_2 + p_3 + \ldots + p_n - (n-1)p_1, \quad (4)$$

$$P_B = p_0 + p_1 + p_3 + \ldots + p_n - (n-1)p_2 \quad (5),$$

etc.

The method of synchronizing actuators and the apparatus implementing said method in accordance with the present invention has the following advantages.

First of all it is necessary to note that the proposed method and apparatus provide sufficiently high accuracy and quickness of synchronization of the actuators. Application of this method and apparatus implementing the same allows to obtain the degree of mismatch of the position of the operating member of the synchronized actuators and, correspondingly, the speeds or moments of the associated objects of adjustment not above 1 percent. High accuracy and quickness of synchronization are achieved due to the fact that:

in the first place, the correction signal applied simultaneously to all the actuators in the proposed synchronizing circuit is greater in magnitude than that in the known circuits because in this circuit said signal is defined by the sum of different signals.

in the second place, in the proposed synchronizing circuit the correction signal for each synchronized actuator is formed only in one adding element, through which, moreover, the signal of common control action is also applied to said actuator, and in the third place, in the course of movement of the operating members of the actuators to the position corresponding to its synchronized state, these operating members move in the directions toward each other and therefore their tracks are not large.

High degree of equalization of the load on the movers associated with the actuators achieved due to high accuracy and quickness of synchronization of said actuators prevents long lasting overloading of the movers which increases the service life of these movers and reduces the probability of failures, as well as decreases the fuel consumption.

Besides, it is necessary to note that the proposed synchronizing apparatus comprises minimum number of comparing devices which are standard adding elements applied in industrial pneumoautomation. This allows to develope a simple, reliable and easily unified construction of the synchronizing apparatus easy for maintenance and for repair.

It is necessary also to point out to the fact that the proposed method and apparatus can be used for synchronizing actuators of many types of primary and secondary movers such as, for example, the internal combustion engines, pneumatic engines, hydraulic engines, etc.

While particular embodiments of the invention have been shown and described, various modifications thereof will be apparent to those skilled in the art and therefore it is not intended that the invention be limited to the description of the proposed method of synchronizing actuators and of the apparatus implementing the same or to the details thereof and the departures may be made therefrom within the spirit and scope of the invention as defined in the appended claims.

COMMERCIAL APPLICABILITY

The present invention can most advantageously be used in multiple-unit transport power plants comprising Diesel engines or turbines and providing the operation of an electric generator requiring that the speed of the power plant engines be kept at a constant level.

We claim:

1. An apparatus for synchronizing actuators, comprising a pressure fluid source associated with a setting device adapted to set a common control action on the movement of the operating member of each actuator, said movement providing the energy medium supply to the prime or secondary movers, and also associated with transmitters of the movements of the operating members of the actuators and with a comparing device adapted to produce a control action on the actuators, said comparing device being associated with the actuators and with the transmitters and representing a multi-chamber adding element having a housing closed at opposite ends and accommodating a stem movable axially in opposite directions relative to its center position and secured to a plurality of diaphragms disposed within the housing, one part of said diaphragms having an effective area of each diaphragm larger than that of the other part, said diaphragms being mounted within the housing in such a manner that the diaphragms with different effective area alternate and divide the interior of the housing into positive control chambers providing the movement of the stem off center in one direction in response to the pressure build up therein, into negative control chambers providing the movement of the stem in the opposite direction in response to the pressure build up therein, an inlet chamber which connects the pressure fluid source with the actuator when the stem is moved is said one direction by the sum of the pressures in the positive control chambers exceeding the sum of the pressures in the negative control chambers, an outlet chamber connected with an inlet chamber and communicated, when the stem is moved in said opposite direction by the sum of the pressures in the negative control chambers exceeding the sum of the pressures in the positive control chambers, with a pressure fluid drain means, characterized in that it further comprises adding elements (17) of the above type and in such a quantity that the total number of the adding elements (17) is equal to the number of synchronized actuators (4), the inlet chamber (36) of each adding element (17) being communicated with one of the negative control chambers (25), (27), (29) of the same adding element (17), one of the positive control chambers (24,), (26), (28) of each adding element (17) being connected with the output of the setting device (6) and the output of the transmitter (10) of the movement of the operating member (5) of each actuator (4) being connected with such a number of negative control chambers (25), (27), (29) of the adding element (17) associated with the same actuator (4), which is one unit less than the number of synchronized actuators (4), and with one of the positive control chambers (24), (26), (28) of the rest of the adding elements (17).

2. An apparatus as set forth in claim 1, characterized in that the output of the transmitted (10) of the movement of the operating member (5) of each actuator (4) is connected to the respective control chambers of the adding elements (17) through an adjustable throttle (57).

3. An apparatus as set forth in claim 1 or 2, characterized in that the inlet chamber (36) of each adding element (17) is connected to the respective actuator (4) through an adjustable throttle (54).

* * * * *